US005743807A

United States Patent [19]

Bendo et al.

[11] Patent Number: 5,743,807

[45] Date of Patent: Apr. 28, 1998

[54] GOLF SWING SOUND TRAINING DEVICE

[75] Inventors: Christopher J. Bendo, Tecumseh; Tibor M. Varga, Belle River, both of Canada

[73] Assignee: Tempo-Tuner Inc., Ontario, Canada

[21] Appl. No.: 590,733

[22] Filed: Jan. 24, 1996

[51] Int. Cl.[6] ..... A63B 69/36

[52] U.S. Cl. ..... 473/234; 434/252; 473/219

[58] Field of Search ..... 84/454, 470 R, 84/484, DIG. 12; 968/820; 473/234, 266, 207, 219; 434/252

[56] References Cited

U.S. PATENT DOCUMENTS

| | | | |
|---|---|---|---|
| 3,808,707 | 5/1974 | Fink | 434/252 |
| 3,882,480 | 5/1975 | Greber | 340/323 R |
| 4,321,853 | 3/1982 | Tumblin | 84/454 |
| 4,477,079 | 10/1984 | White | 473/221 |
| 4,577,868 | 3/1986 | Kiyonaga | 473/269 |
| 5,027,686 | 7/1991 | Ishikawa | 84/484 |
| 5,040,790 | 8/1991 | Anthes et al. | 273/446 |
| 5,082,281 | 1/1992 | Berghofer | 473/207 |
| 5,368,042 | 11/1994 | O'Neal et al. | 128/733 |
| 5,423,538 | 6/1995 | Stewart | 473/225 |
| 5,558,519 | 9/1996 | Sabowitz | 473/219 |

OTHER PUBLICATIONS

Pure Tempo Advertisement and Order Form, Ontrak Technologies, Website: http:/www.ontrak.com, Apr. 1, 1996, 6 pages.

*Primary Examiner*—George Manuel

*Attorney, Agent, or Firm*—Harness, Dickey & Pierce, P.L.C.

[57] ABSTRACT

A timing device for training an athlete to perform an athletic endeavor in a repeatable, rhythmic manner to thereby improve his or her performance. A controller is programmed to output audible timing pattern signals in response to a set of timing data input into the controller. A transmitter is operatively connected to the controller for transmitting these signals to the athlete. The pattern preferably includes a first plurality of signals forming a preliminary time interval that permits the athlete to become set in his or her stance. The timing pattern also includes an initialization signal that prepares the athlete to begin his or her performance. The timing pattern also includes a second plurality of signals having a preset tempo that indicates to the individual sequential points in the athletic endeavor. By performing the task at a tempo synchronous with the tempo set by the second plurality of signals, an athlete can develop a rhythmic, repeatable approach and thereby improve his or her athletic performance. The present invention is particularly useful in training a golfer to improve his/her golf swing mechanics.

17 Claims, 4 Drawing Sheets

GOLF SWING SOUND TRAINING DEVICE

BACKGROUND OF INVENTION

This invention generally relates to biomechanical motion and, more particularly, to a device and corresponding method for training an individual to swing a golf club in rhythm with a target golf swing tempo.

Golfers of all skill levels constantly seek to improve their respective golf games. This fact has led to the introduction over the years of numerous golf instructional tools. These instructional tools today vary greatly in both cost and effectiveness in improving a golfer's game. Also, these tools are offered in a variety of formats, ranging from typically inexpensive self-help books and videotapes to typically expensive and often elaborate mechanical devices. Additionally, taking lessons from a professional golfer is a highly effective and frequently used method of improving one's game.

The majority of the above-mentioned instructional tools focus on golf swing mechanics and, in particular, on biomechanical aspects, such as the relative location of a golfer's legs, hips and hands at various sequential points in the golfer's swing. These tools also typically focus on other biomechanical aspects such as correct positioning of a golf ball in one's stance or the correct alignment of one's shoulders and hips with an intended target.

While the above-mentioned instructional tools aid the present day golfer in improving his or her golf game, these tools have associated limitations. While tapes and books are helpful in certain aspects, such tools can not typically be used simultaneously with actual practice. Further, mechanical devices are often expensive, bulky, and/or limited in scope of instruction, thereby limiting their training effectiveness. Further, lessons from a professional golfer, while highly effective, are often expensive, are limited in duration and cannot be replayed, as can video or audio tapes.

Few of the aforementioned golf instructional tools directly address the tempo, or timing, aspect of a golfer's swing. Development of a consistent, repeatable rhythmic swing is important in one's overall performance on the golf course. If one particular phase of a golfer's swing is out of synch with the other phases, typically the result is a less than optimal striking of the golf ball.

Similarly, development of a consistent, repeatable pattern in other athletic endeavors is also essential to optimum performance. However, few effective training devices exist that aid an athlete performing such an athletic endeavor to develop a consistent, repeatable approach.

Thus, there exists a need for a simple, relatively inexpensive, durable and compact device constructed to aid a golfer in developing a rhythmic, repeatable golf swing. Further, there is a need for a golf swing timing device that may be used in a repetitive manner as a golfer swings a golf club in response to a tempo set by a preset pattern of signals. In addition, there is also a need for a golf swing timing device that includes a timing pattern that may be tailored to a particular golfer's swing or that may use a proven timing pattern, such as the timing pattern associated with the swing of a professional golfer. There is also a more general need for a training device that aids an athlete in developing a consistent, repeatable approach to an athletic endeavor.

SUMMARY OF THE INVENTION

This invention contemplates providing an apparatus and corresponding method for training an athlete to perform an athletic endeavor, and particularly one requiring a backward movement of arms and/or legs, a pause, and a subsequent forward movement of the arms and/or legs, as is involved in a golf swing, in a rhythmic, repeatable manner. The apparatus includes a controller that is programmed to output a timing pattern, consisting of a set of audible signals such as tones or clicks, generated from a set of timing data programmed into the controller. Further, the device includes a transmitter operatively connected to the controller for transmitting signals, corresponding to the timing pattern, to the athlete. The timing pattern includes a first plurality of signals comprising a preliminary time interval that allows the athlete time to finish an athletic endeavor and to prepare for a subsequent athletic endeavor. The timing pattern also includes an initialization signal that indicates to an athlete when to prepare to begin his or her athletic endeavor. The timing pattern also includes a second plurality of signals that indicate to the athlete preselected, sequential points in his or her athletic endeavor. The second plurality of signals has a preset tempo that allows the athlete to perform his or her athletic endeavor at a tempo, or rate, that is synchronous with the tempo set by the second plurality of signals.

According to a second embodiment of the present invention, a method is provided for training an athlete to perform an athletic endeavor in rhythm with a tempo conveyed to the athlete through a series of audible signals. A controller is provided for outputting a timing pattern in response to a set of timing data programmed into the controller. Also, a transmitter is provided for transmitting to the athlete audible signals corresponding to the timing pattern output by the controller. Initially, a first plurality of signals forming a preliminary timing pattern is transmitted to the athlete. Next, an initializing signal is transmitted to the athlete to prepare the athlete to begin his or her athletic endeavor. Finally, a second plurality of signals is transmitted to the athlete. This second plurality of signals is generated to indicate sequential points in the athletic endeavor, such as a rearward movement of a limb or limbs, a pause, and a corresponding forward movement. The athlete can thereby perform the athletic endeavor at a tempo synchronous with the tempo set by the second plurality of signals. This method is repeatable, thereby allowing an athlete to repeatably practice to the timing pattern to thereby develop a smooth, consistent, rhythmic pattern and thereby develop better associated mechanics.

An object of this invention is to provide a timing device that utilizes electronic components to produce and emit a sequence of signals forming a timing pattern to aid a golfer in developing a repeatable, rhythmic golf swing.

It is yet another object of the present invention to provide a simple, relatively inexpensive, durable compact training device constructed to aid a golfer in improving his or her golf swing or any athletic endeavor.

It is yet another object of the present invention to provide a timing device that produces a timing pattern that may be tailored to a particular golfer's timing characteristics or that may alternatively produce a proven timing pattern, such as one associated with that of a professional golfer.

It is yet another object of the present invention to provide a training device that aids an athlete in developing a repeatable, consistent approach to his or her athletic endeavor.

These and other objects and advantages of this invention will become apparent upon reading the following description, of which the attached drawings form a part.

DETAILED DESCRIPTION

Figure 1:
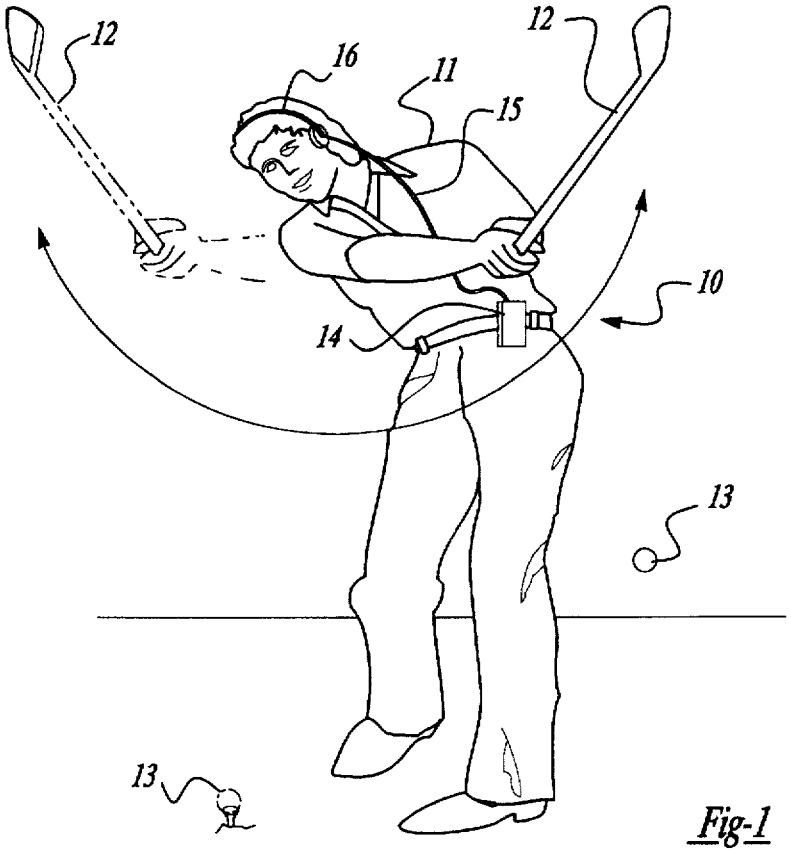
FIG. 1 illustrates a golf swing timing device according to the present invention implemented in a preferred environment.

Referring to the drawings, FIG. 1 shows a golf swing timing device generally at 10 being utilized by a golfer 11 swinging a golf club 12 so as to strike a golf ball 13. Generally, the golf swing timing device 10 includes components, described in detail below, operatively mounted within a housing 14. The components are programmed, in a manner described in detail below, to output a pattern of audible signals, such as tones and clicks, to the golfer through a wire 15 to a headset 16 of the type well known to those skilled in the art. This pattern of audible signals forms a golf swing timing pattern. By repetitively swinging the golf club 12 in a pattern synchronous with the timing pattern emitted by the timing device, a golfer can develop an optimal golf swing rhythm to train muscles associated with the golf swing and develop muscle and mental memory, thereby improving his or her golf swing mechanics.

Figure 2:
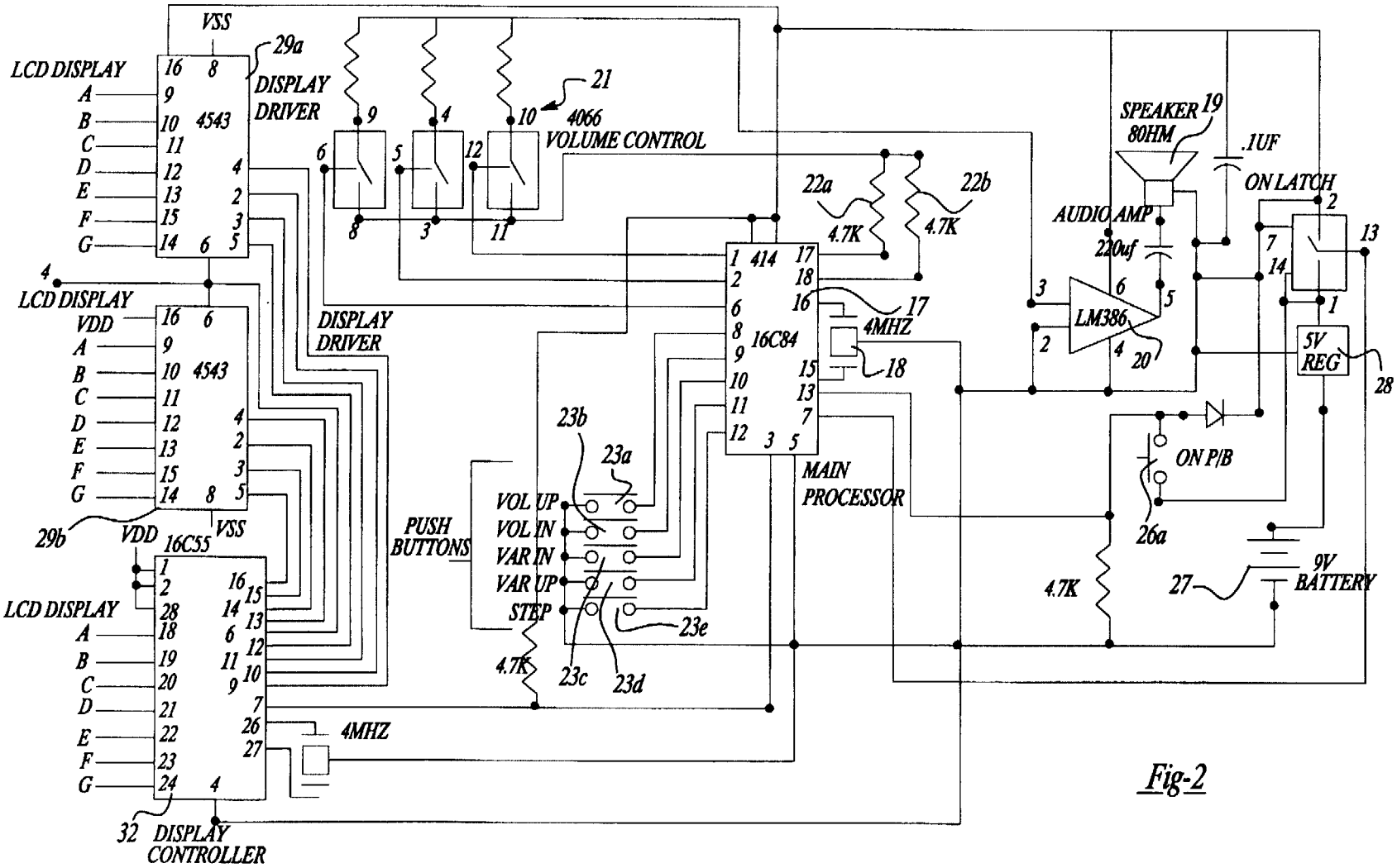
FIG. 2 is a schematic diagram of a control circuit used to implement the golf swing timing device of the present invention.

FIG. 2 is a schematic diagram illustrating the components located within the housing 14 used to create an output of the golf swing timing pattern. Although the components shown are contemplated for use in one preferred embodiment of the present invention, it should be appreciated that numerous other configurations of digital and/or analog components could be used to implement the timing device of the present invention in accordance with particular desired timing device parameters without departing from the scope of the present invention.

As shown in FIG. 2, the device includes a main processor 17 of the type well known to those skilled in the art. It should be understood that any type of programmable microcontroller device may also be used such as a microprocessor or an EEPROM. The processor 17 is in turn driven by a crystal resonator 18. The processor 17 is programmed in a manner well known to those skilled in the art with a preselected number of golf swing timing patterns, which allow a golfer to choose among various particular timing patterns. Golf swing timing pattern audible signals generated by the processor 17 are output through a speaker 19, which is driven by an operational amplifier 20 of the type well known to those skilled in the art. Output signal volume is controlled by volume control circuitry 21 operatively connected to an input of the op amp 20 and to the processor 17 through resistors **22*a*, 22*b*. Device volume and golf swing timing rate are adjusted through control switches 23*a–e* which are connected to user-accessible control buttons 24*a–e*** shown in FIG. 3.

Figure 3:
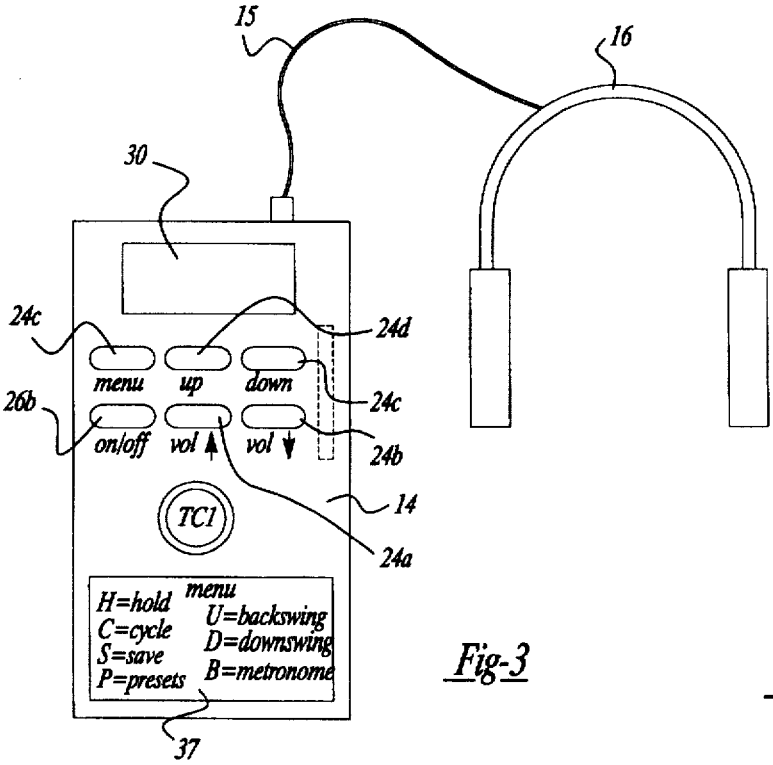
FIG. 3 is a front elevational view of a golf swing timing device according to a preferred embodiment of the present invention.

Power is supplied to the control circuit through selective control of the ON/OFF switch **26*a* which is selectively controlled through ON/OFF button 26*b* shown in FIG. 3. When the switch is moved into a closed position, power is supplied to the control circuit from a DC power source 27, which is typically a 9 V battery. This DC power is then converted to 5 V DC through a voltage regulator 28 before being supplied to the processor 17, as is standard in the microelectronics art. Further, display drivers 29*a*, 29*b* are operative to drive a device display 30 (FIG. 3), which is preferably a liquid crystal display (LCD) of the type well known in the art. The LCD 38 is connected to the EEPROM 17 and displays the golf swing timing pattern and control information. Additionally, the LCD may be operative to display other timing device parameters such as volume level, or battery power level, in a manner well known to those skilled in the art. Operation of the display drivers are controlled by a display controller 31 and by the processor 17**.

FIG. 3 illustrates the outer structure of the golf swing timing device according to a preferred embodiment of the present invention. The actual placement and function of the controls shown in FIG. 3 may vary according to particular design parameters without departing from the scope of the present invention. As shown, the housing 14 includes the timing device ON/OFF button **26*b* operatively associated with the switch 26*a*. Further, the timing device includes volume control buttons 24*a*, 24*b* operatively connected to the switches 23*a*, 23*b* to allow the golfer to selectively adjust the volume of the golf swing timing pattern signals emitted through the head set 16. In addition, a menu button 24*e* is connected to the switch 25*e* and allows the golfer to select among a number of preset timing patterns, such as those of famous golfers, by successively depressing and releasing the button until the letter "P", which a menu 37 located at the bottom of the housing indicates as the PRESET function, appears on the display 30. Subsequent to the letter "P" appearing, the golfer may then choose among a variety of preset patterns through use of the UP/DOWN buttons 24*d*, 24*c* which are operatively connected to the switches 23*d*, 23*c*. Further, the menu button 24*e*** also functions as a tempo adjust to allow a golfer to either speed up or slow down the signal pattern created and emitted by the timing device.

Through selective operation of the device control buttons, the golfer may adjust the overall rate of the timing pattern tempo or, alternatively, to selectively adjust individual stages of the timing pattern, such as the backswing stage, the pause at the end of the backswing stage, or the downswing stage. For example, the golfer may tailor the tempo of the backswing segment to fit his or her particular swing by first successively depressing and releasing the menu button **24*e* until the letter "b" appears on the LCD 30, along with the backswing segment duration, which appears as an integer number representing the number of thirtieths of a second intervals comprising the backswing segment duration. The UP/DOWN buttons 24*d*, 24*c* are then used to increase or decrease the backswing segment duration. Once the desired duration is reached, the MENU button 24*e* is successively depressed and released to scroll until the letter "S" appears on the LCD, indicating the selection of the SAVE option. The ON/OFF button is then depressed, and the new backswing timing segment is saved in the device processor 17**.

As indicated on the MENU 37, other device functions may be selectively manipulated in a similar fashion, including the pause between the backswing and the downswing ("H"=HOLD), the number of cycles occurring before the golf swing sequence is initiated ("C"=CYCLES) as described below, the duration of the downswing segment ("d"=DOWNSWING), and the sequential spacing of beeps during the pre-swing cycle ("π"=METRONOME).

Figure 4:
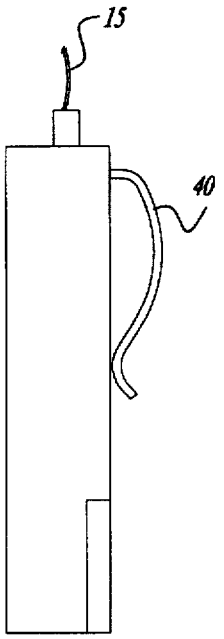
FIG. 4 is a side view of the timing device shown in FIG. 3.

As shown in FIG. 4, the rear side of the housing 10 includes a clip 40 that allows the golfer to attach the housing to the golfer's belt, thereby positioning the device in a location that will not interfere with the golfer's swing. Alternatively, the device housing could be attached via velcro, an arm strap or any other type of commercially available fastener.

Figure 5:
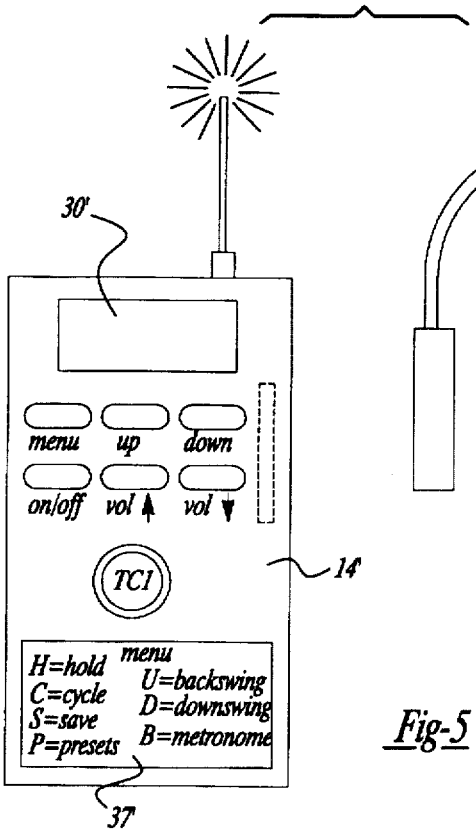
FIG. 5 is a front elevational view of a golf swing timing device according to a second embodiment of the present invention.

It should be understood at this point that the actual configuration of the timing device 10 may vary according to particular needs and anticipated conditions. For example, as shown in FIG. 5, a golf swing timing device 10' is shown that includes a housing 14' in communication with a head set 16' through a wireless radio frequency communication mode of the type well known to those skilled in the art. Additionally, it is contemplated that the housing and the head set may be integrated into a single piece component. Further, it is contemplated that the timing device may also be implemented in a portable stereo type environment remote from the golfer.

Figure 7A:
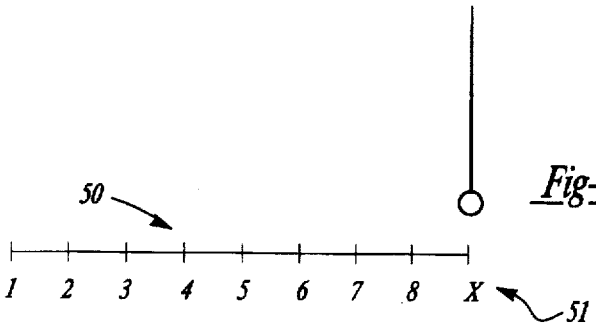
FIGS. 7A–7G are timing schematic diagrams illustrating the sequential operation of the golf swing timing device in correlation with the swinging of a golf club according to a preferred embodiment of the present invention.

Referring now to FIGS. 7A–7G, operation of the golf swing timing device of the present invention will now be described. As shown in FIG. 7A, the device 10 outputs a predetermined number of audible pre-swing signals, which are preferably clicking sounds, or clicks, spaced apart in time from one another by a predetermined time interval and indicated generally by the numerals shown at 50. The time period formed by these clicks allows the golfer to finish his or her routine from a previous swing, place another golf ball in position, and reset himself or herself in a pre-swing stance. Preferably, the pre-swing timing pattern is programmed into the processor 17 to equal the total amount of time taken for both the golfer's backswing, pause and downswing. However, this reset time may be increased or decreased as previously described and thus set according to a golfer's particular needs. After a predetermined number of clicks, which preferably range in number from between four and sixteen, a pre-swing tone, indicated by the X at 51, is generated to give notice to the golfer that the golf swing timing pattern is about to begin.

Figure 7B:
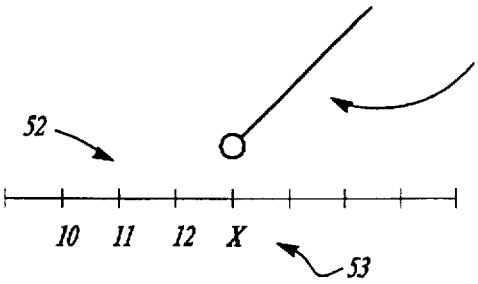

As shown in FIG. 7B, subsequent to the generation of the pre-swing tone 51, a second sequence of clicks, indicated generally by the numerals at 52, is generated. This second sequence of clicks, which preferably consists of a series of four clicks, but may vary in number according to a particular golfer's preference, provides the golfer with a countdown to the beginning of the golf swing timing pattern. At the end of the second sequence of clicks, a backswing tone, indicated by the X at 53, is generated to signal that the golfer should begin his or her backswing. This backswing tone continues for a period of time corresponding directly with the amount of time it should ideally take the golfer to reach the top of his or her backswing. Alternatively, the device may be programmed so that the tone rises in pitch during the backswing tone and correspondingly drops in pitch during the downswing tone.

Figure 7C:
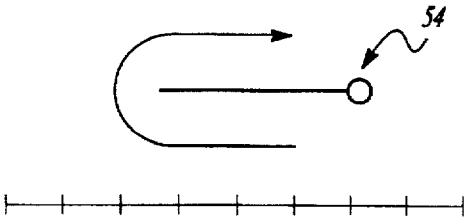
Figure 7D:
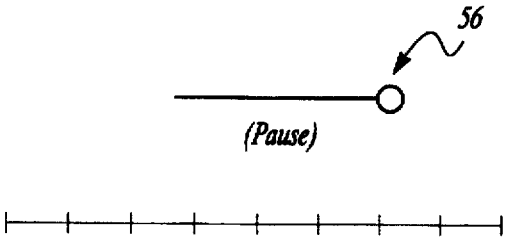

As indicated at 54 in FIG. 7C, the end of the backswing tone corresponds to the top of the golfer's backswing. Subsequently, a pause, indicated generally at 56 in FIG. 7D, occurs in the timing pattern. This pause indicates to the golfer that he or she should stop the motion of the golf club momentarily at the top of the backswing before beginning the downswing.

Figure 7E:
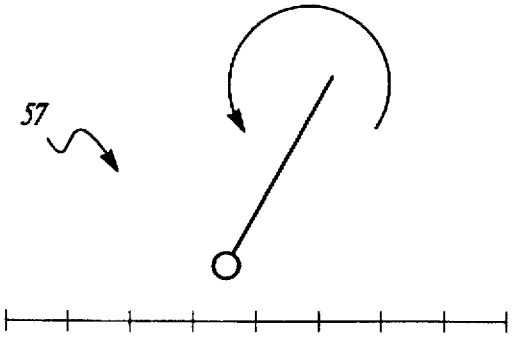
Figure 7F:
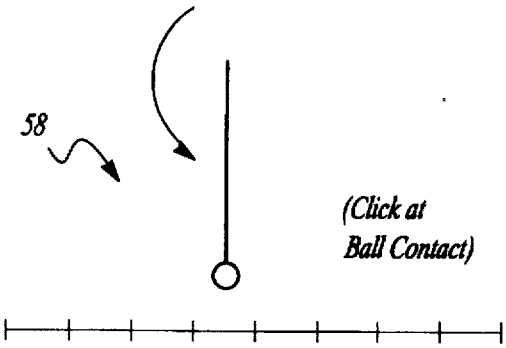

As shown generally at 57 in FIG. 7E, subsequent to this short pause, a downswing tone is generated, indicating to the golfer to begin his or her downswing. This downswing tone is generated for an amount of time corresponding to the length of time it should ideally take the golfer to complete his or her downswing to ball contact or through the golfer's full forward motion.

Figure 6:
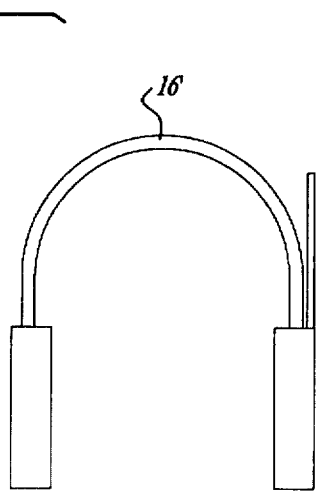
FIG. 6 is a side view of the timing device shown in FIG. 5.
Figure 6:
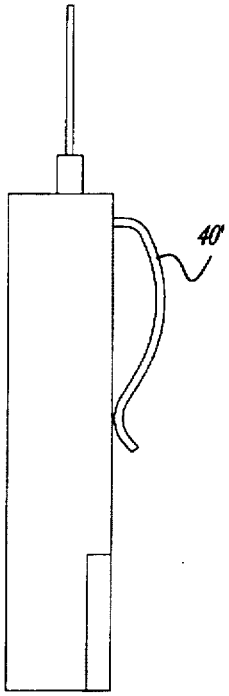

At the end of the downswing tone, a click is generated. As indicated at 58 in FIG. 6F, the click is generated at a time which ideally corresponds to the point in time at which the golfer's club strikes the golf ball.

Figure 7G:
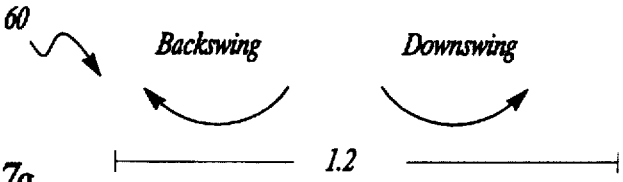

As indicated at 60 in FIG. 7G, the total time swing sequence is ideally between 0.8 and 1.2 seconds. This is the total time it should take the golfer to complete his or her entire swing, including both the backswing and the downswing. Because this time sequence may vary according to each individual golfer and according to the particular size and type of club being used, the golfer may adjust the time sequence through the buttons **35*c*–35*e*** as described above.

Further, an additional tone sequence or sequences could be added to the above tone sequences. For example, a follow through tone sequence could be added if it is desired to train the golfer a follow through swing timing subsequent to ball contact. Such a timing sequence could be programmed into the timing device of the present invention in a method identical to the previously discussed method. Also, the time intervals may be broken into larger or smaller intervals according to the expected timing accuracy of the end user. For example, the timing sequence could be programmed to be broken into thousandths of a second rather than thirtieths of a second if such precision is so desired.

It should be appreciated that an individual's particular golf swing timing pattern may be determined by recording the individual's golf swing on a device such as a video tape recorder and then timing the swing to determine the length of time of the backswing, the pause at the top of the backswing and the length of time of the downswing. The target time period for these individual stages of the golf swing may then be set through the device buttons as described above. Preferably, the backswing and downswing time periods are adjustable in increments of 1/30th of a second, while the pause between the backswing and the downswing is adjustable in increments of 1/60th of a second. Alternatively, a preset timing pattern, such as that of a professional golfer, may also be adjusted if such a timing pattern is used.

While the sequence of signals comprising the golf swing timing pattern described above are preferably audible signals, it should be understood that these signals could also be visual signals, audiovisual signals, or a combination of audible and visual signals.

Also, while the golf swing timing device as shown above is shown implemented to train an individual to swing a golf club in a repeatable, rhythmic manner, it is also contemplated that the present invention may be used to train an individual to perform any type of athletic endeavor or biomechanical motion in a repeatable, rhythmic manner. It is contemplated that such athletic endeavors/biomechanical motion may include shooting a basketball, bowling a bowling ball, serving a tennis ball, or any other like task that involves a rhythmic biomechanical sequence of events and, in particular, a biomechanical task involving a backward movement involving limbs such as the legs and/or arms, a pause, and a forward movement involving limbs such as the legs and/or arms.

This invention may be further developed within the scope of the following claims. Thus, the foregoing description is intended to be illustrative of an operative embodiment and not in a strictly limiting sense. Having fully described an operative embodiment of this invention.

We now claim:

1. An apparatus for training an athlete to perform an athletic endeavor requiring a biomechanical motion in rhythm with a predetermined tempo, said biomechanical motion including a backward movement involving at least one bodily limb, a pause, and a forward movement of at least one bodily limb, said apparatus comprising:

a housing;

a controller operatively located within said housing and programmed to output a timing pattern in response to a set of preselected timing data; and a transmitter operatively connected to said controller for transmitting signals to said athlete corresponding to said timing pattern, said timing pattern including a first plurality of signals corresponding to a preliminary time interval, said timing pattern further including an initialization signal indicating to said athlete an athletic endeavor starting point, said timing pattern further including a second plurality of signals that form a preset timing pattern that initially rises in pitch, and subsequently falls in pitch, corresponding to said backward and forward movements, respectively, associated with said biomechanical motion to train said athlete to perform said athletic endeavor in response to, and at a tempo synchronous with, that of said second plurality of signals.

2. The apparatus of claim 1, wherein said controller further comprises an adjustment device for adjusting said timing pattern according to desired individual parameters.

3. The apparatus of claim 1, wherein said second plurality of signals comprises a backward movement tone, a forward movement tone and a movement finishing signal.

4. The apparatus of claim 1, wherein said athlete endeavor comprises a golf swing, and wherein said second plurality of signals comprises a backswing tone, a pause, a downswing tone and a ball contact signal.

5. The apparatus of claim 1, wherein said first plurality of signals comprises a plurality of clicks spaced equally apart in time from one another.

6. The apparatus of claim 1, wherein said first plurality of signals is equal in duration to said second plurality of signals.

7. The apparatus of claim 1, wherein said first plurality of signals is unequal in duration to said second plurality of signals.

8. The apparatus of claim 1, wherein said transmitter transmits an audio signal.

9. The golf swing timing device of claim 1, wherein said transmitter comprises a head set in wireless communication with said controller.

10. The apparatus of claim 1, wherein said transmitter comprises a head set in communication with said controller through a wire connection.

11. The apparatus of claim 1, further comprising a selector control for selecting among a plurality of sets of sample timing data stored in said controller.

12. A method of training an athlete to perform an athletic endeavor requiring a biomechanical motion in rhythm with a predetermined tempo, said biomechanical motion including a backward movement involving at least one bodily limb, a pause, and a forward movement involving at least one bodily limb, said method comprising:

a) providing a controller programmed to output a timing pattern in response to a preselected set of athlete endeavor timing data;

b) providing a transmitter in communication with said controller for transmitting signals corresponding to said timing pattern;

c) transmitting to said athlete a first plurality of signals forming a preliminary timing pattern;

d) transmitting an initializing signal indicating to said athlete an athletic endeavor starting point; and e) transmitting to said athlete a second plurality of signals that forms a preset timing pattern, said preset timing pattern rising in pitch to emulate an initial group of biomechanical movements, and falling in pitch to emulate a subsequent group of biomechanical movements, thereby allowing said athlete to perform said athletic endeavor at a tempo synchronous with said tempo and pitch of said second plurality of signals.

13. The method of claim 12, further comprising the step of programming a plurality of sets of said athletic endeavor timing data into said controller.

14. The method of claim 12, further comprising repeating steps (a), (b), (c), (d) and (e) a predetermined number of times to train said athlete to perform said athletic endeavor in a repeatable manner.

15. The method of claim 12, wherein said step of transmitting to said athlete a second plurality of signals comprises transmitting a backward movement tone and a forward movement tone.

16. A method of training an individual to perform a biomechanical task in a repeatable, rhythmic manner, comprising the steps of:

a) providing a controller programmed to output a timing pattern in response to a preselected set of biomechanical task timing data;

b) providing a transmitter operatively controlled by said controller for transmitting signals corresponding to said timing pattern;

c) transmitting to said individual a first plurality of signals forming a preliminary timing pattern;

e) transmitting to said individual an initializing signal indicating a starting point of said biomechanical task; and f) transmitting to said individual a second plurality of signals corresponding to sequential target stages of said task, said second plurality of signals forming a preset timing pattern that rises in pitch corresponding to a first group of biomechanical movements, and that falls in pitch corresponding to a second group of subsequent biomechanical movements, thereby training said individual to perform said task at a tempo synchronous with said tempo and pitch of said second plurality of signals.

17. A method of training an athlete to perform an athletic endeavor requiring a biomechanical motion in rhythm with a predetermined tempo, comprising the steps of:

a) providing a controller programmed to output a timing pattern in response to a preselected set of athlete endeavor timing data;

b) providing a transmitter in communication with said controller for transmitting signals corresponding to said timing pattern;

c) transmitting to said athlete a first plurality of signals forming a preliminary timing pattern;

d) transmitting an initializing signal indicating to said athlete an athletic endeavor starting point; and e) transmitting to said athlete a second plurality of signals corresponding to sequential points of said athletic endeavor, thereby allowing said athlete to perform said athletic endeavor at a tempo synchronous with said tempo set by said second plurality of signals;

said athletic endeavor comprising swinging a golf club and said step of transmitting to said athlete a second plurality of signals comprising transmitting a backswing tone, a pause, a downswing tone and a ball contact signal.

* * * * *